United States Patent [19]

Pierson et al.

[11] Patent Number: 4,978,499

[45] Date of Patent: Dec. 18, 1990

[54] SOFT STEEL FOR MACHINE CUTTING AND METHOD OF PRODUCING IT

[75] Inventors: Gilles Pierson, Chenieres; Louis Payraudeau, Metz; Jean Bellot, Pompey, all of France

[73] Assignee: Unimetal, Metz Cedex, France

[21] Appl. No.: 444,259

[22] Filed: Dec. 1, 1989

[30] Foreign Application Priority Data

Jan. 12, 1988 [FR] France ..... 88 16093

[51] Int. Cl.[5] ..... C22C 38/60

[52] U.S. Cl. ..... 420/87; 420/84; 420/85; 420/88; 420/129; 75/567; 75/568

[58] Field of Search ..... 420/84, 85, 87, 88, 420/129; 75/567, 568

[56] References Cited

U.S. PATENT DOCUMENTS

| | | | |
|---|---|---|---|
| 3,844,773 | 10/1974 | Yamakoshi et al. | 420/84 |
| 3,948,649 | 4/1976 | Tetsuo Takahashi et al. | 420/84 |
| 3,973,950 | 8/1976 | Itoh et al. | 420/84 |
| 4,881,990 | 11/1989 | Pielet et al. | 420/87 |

FOREIGN PATENT DOCUMENTS

| | | | |
|---|---|---|---|
| 2445388 | 7/1980 | France . | |
| 54-116317 | 9/1979 | Japan | 420/84 |
| 359326 | 10/1931 | United Kingdom . | |

*Primary Examiner*—Deborah Yee

*Attorney, Agent, or Firm*—Pollock, Vande Sande & Priddy

[57] ABSTRACT

A soft steel for machine cutting with high machinability performances having a content of C≦0.25%, a content of Mn of 0.8 to 1.5%, a content of P of ≦0.1%, a content of S of 0.15 to 0.40%, and a content of Si of 0.05 to 0.40%, expressed in percentages by weight. After finishing of the metal, the inclusions of manganese sulfide are surrounded by a plastic oxide layer of an average composition $SiO_2$: 35 to 45%; $Al_2O_3$: 10 to 20%; CaO: 15 to 25%; MnO: 10 to 20%. In producing this grade, after the addition of silicon and manganese, the liquid metal is agitated in the presence of a slag of a composition CaO: 20 to 55%; $SiO_2$: 35 to 65%; $Al_2O_3$: 15 to 40%; with a CaO %/$SiO_2$% ratio of about 1.

8 Claims, No Drawings

SOFT STEEL FOR MACHINE CUTTING AND METHOD OF PRODUCING IT

FIELD OF THE INVENTION

The present invention relates to the sector of soft steels for machine cutting with improved cutting performances.

PRIOR ART

Machine-cutting steels are intended for the machining of various components by means of fast-cutting machine-tools, such as lathes. One of the main properties demanded of this type of steel is to cause the least possible wear of the cutting tool. In fact, low wear allows high cutting speeds, accompanied by a high productivity of the machine, or a long lifetime of the cutting tool.

The composition of machine-cutting steels is conventionally selected in such a way that present within them are numerous inclusions of manganese sulfide performing the function of improving machinability performance, especially by making the fragmentation of the chips easier and by limiting the wear of the cutting tools. Consequently, machine-cutting steels contain high contents of sulfur (from 0.1 to 0.3 % by weight and above) and of manganese (up to 1.5 %).

When especially high machinability is desired, it is possible to use a soft steel for machine cutting which is taken, for example, from the grades S250, S250Pb, S300 or S300Pb in the standard NF-A- 35561. These grades are characterized by:

accepted very low contents of silicon (less than 0.05 % and preferably less than 0.02%), to avoid the presence of hard inclusions of silica which would damage the cutting tool;

the possible addition to the metal of a considerable quantity of lead (0.20 to 0.30 %), the function of which is to increase the lubricating effect of the inclusions of manganese sulfide during cutting.

However, this addition of lead has serious disadvantages. First of all, it is difficult to carry out the addition and dissolution of the lead in the liquid steel with sufficient uniformity. Because of its high density, it tends to accumulate in the bottom of the metallurgical vessels. Above all, when it is being introduced into the liquid metal, its especially low evaporation temperature causes highly toxic lead oxide smoke to form. To protect the operators, it is necessary to employ a system for capturing the smoke at the metal treatment station and medical supervision of the personnel attending to the operation of the installation.

It will therefore be appreciated that it would be highly desirable, in this type of grade of steel, to replace the lead by a material leaving equivalent cutting properties, without any disadvantages in terms of production.

Elements such as bismuth could be substituted for the lead, but their very high cost makes their use almost prohibitive for the mass production of machine steels.

SUMMARY OF THE INVENTION

The object of the invention is to provide a soft steel for machine cutting, the machinability performances of which are at least equal to those of the grades with lead of the types S250Pb and S300Pb, without an addition of this element being necessary.

To this end, the subject of the invention is a soft steel for machine cutting, wherein:

its composition is $C \leqq 0.25\%$; $Mn=0.8-1.5\%$; $P \leqq 0.1\%$; $S=0.15-0.40\%$; $Si=0.05-0.40\%$, expressed in percentages by weight, and, after the finishing of the metal, the inclusions of manganese sulfide are surrounded by a plastic oxide layer of an average composition of the type: $SiO_2$: 35 to 45%; $Al_2O_3$: 10 to 20%; CaO : 15 to 25%; MnO : 10 to 20%, likewise expressed in percentages by weight.

Advantageously, the carbon content is below or equal to 0.16%, even preferably to 0.09% which is the most commonly accepted content for soft machine-cutting steels. It can also contain calcium in a content of 5 to 50 ppm and/or tellurium in a content of 5 to 200 ppm.

Another subject of the invention is a method for producing, in the liquid state, such a steel for machine cutting, wherein, after the addition of silicon and manganese to the metal bath, the latter is agitated in a metallurgical vessel in the presence of a slag of which the composition, expressed in percentages by weight, is CaO : 20 to 55%; $SiO_2$: 35 to 65%; $Al_2O_3$: 15 to 40%; with CaO% in the neighborhood of 1.

$SiO_2$%) Optionally, the addition of silicon is accompanied by the addition of 0.1 to 0.3 kg of aluminum per ton of steel, to make it easier to obtain the desired composition for the oxides.

DESCRIPTION OF THE PREFERRED EMBODIMENT

As will have been appreciated, the invention makes it possible to obtain a soft steel for machine cutting with high machinability performance, without resorting to the addition to the liquid metal of lead or of a costly or polluting element of equivalent function. In the finished metal, the inclusions of manganese sulfide are thus enveloped in a layer of high plasticity, consisting of oxides of which the average composition is within a specific range. This range corresponds to the plastic sector of the ternary diagram $CaO-SiO_2-Al_2O_3$, the oxide MnO being assimilated to the oxide CaO.

In terms of the composition by weight, the grades according to the invention differ from the soft machine cutting steels S250 and S300 conventionally used (and defined by the standard NF-A-35561) in the presence of significant quantities of silicon. As seen previously, the silicon (and, in general, the strong deoxidants, such as aluminum) capture the oxygen dissolved in the metal, to form hard inclusions whose presence in significant quantities in the machine-cutting steels can have a harmful effect. The standards relating to the most common machine-cutting steels therefore prescribe very low levels of silicon.

The inventors, contradicting the ideas commonly accepted and laid down by the standards, showed that, under some conditions, significantly large quantities of silicon could be present in a soft machine-cutting steel of high machinability, without the practical properties of the products being adversely affected thereby. For some uses, these new grades with silicon prove to have even higher performances than the conventional grades enriched with lead.

This incorporation of silicon in the metal must necessarily be accompanied by a production method which makes it possible:

to eliminate a large proportion of the inclusions formed during the introduction of the silicon into the liquid steel, especially the inclusions of pure silica;

to convert the remaining oxidized inclusions into plastic inclusions whose behaviour during the solidification of the metal and the subsequent finishing processes is similar to that of the lead in grades of steel with lead for machine cutting.

The purpose of the possible incorporation of 5 to 200 ppm of tellurium is to limit the hot deformability of the sulfides. This makes it possible, after finishing, to prevent the sulfides from assuming an excessively elongate form which would considerably impair the isotropy of the mechanical properties of the metal. This function can also be performed by calcium. However, this element must be added only in specific limited quantities, to prevent the oxide inclusions from having too high a CaO content which would be detrimental to their deformability.

These grades can be produced in the following way. At the time when the metal is poured into a metallurgical vessel, for example a treatment ladle, the additions of silicon, carbon, manganese, sulfur and, if appropriate, tellurium, which are necessary to obtain the desired composition for the metal, are carried out. Also added are the mineral materials such as lime, wollastonite and alumina, which are necessary for obtaining a slag of which the composition is within the range: CaO : 20 to 55%; $SiO_2$ : 35 to 65%; $Al_2O_3$: 15 to 40%. On the other hand, the ratio of the contents of CaO and $SiO_2$ in this slag, which expresses its basicity ratio, must preferably be in the neighborhood of 1. To obtain this slag composition by means of additions as standardized as possible, it is preferable to pour the metal into the treatment ladle, at the same time allowing to enter the latter only a small quantity, of slag coming from the primary production furnace (converter or electric furnace). This can be carried out by means of known devices for the retention of the slag in the furnace, or by means of decantation of metal from ladle to ladle. The liquid steel is subsequently agitated in the treatment ladle for a sufficient period of time (30 minutes or more), in order, as far as possible, to eliminate the inclusions of pure silica which formed during the deoxidation of the metal. On the other hand, this agitation makes it possible to put the liquid metal into thermodynamic equilibrium with the slag, so that the remaining oxidized inclusions have the desired composition defined above. This agitation is carried out by known means, such as a blowing in of gas or the application of an electromagnetic field to the metal. During this production, the compositions of the metal and of the slag are monitored and any corrections which may be necessary are made.

The deoxidation of the metal can be carried out partially with aluminum at the rate of an addition of 0.1 to 0.3 kg per ton of liquid metal, which accompanies the addition of silicon. This makes it possible to reduce the quantity of inclusions of pure silica formed at this moment and to make it easier to obtain the intended composition for the oxides.

If an addition of calcium proves expedient to obtain the desired composition for the inclusions of oxides more easily, or if the plasticity of the sulfides is to be limited, this addition must be carried out towards the end of the production process, preferably by the blowing in of powder or the unwinding of core wire. The quantity usually added is 150 g of calcium per ton of steel.

The ingot-casting or continuous casting of the metal is subsequently carried out under the same conditions as for the conventional grades of machine cutting steel, as are the later metallurgical finishing and treatment operations which make it possible to obtain a product ready for final manufacture.

As an example, the lifetime of a high-speed steel tool, during the machining of a soft machine-cutting steel according to the invention, of a composition of 0.1% of C; 0.97% of Mn; 0.06% of P; 0.30% of S; 0.17% of Si; 70 ppm of Te; 9 ppm of Ca; and without Pb, is 60 minutes at a cutting speed of 150 m/min. These results are similar to those reloaded during the machining of a lead-enriched soft steel for machine cutting S 300 Pb.

On the other hand, at cutting speeds higher than 200 m/min., a carbide tool P30 makes it possible, for an equal lifetime of the tool, to triple the cutting speed during the machining of the steel according to the invention just mentioned, in comparison with the machining of an S 300 Pb steel.

It is possible to add to the claimed grades elements which are not mentioned and the presence of which does not call into question the plasticity of the inclusions obtained. On the other hand, the addition of silicon and the formation of plastic oxidized inclusions can not only be substituted for an addition of lead, as just described, but also take place in conjunction with such an addition. The quantities of lead added could then be lower than those usually used.

Alternative versions in the production and casting of the liquid metal and in the initial conversions of the metal are likewise possible. For example, the grading operations can be carried out under a vacuum, in order to reduce the contents of dissolved gases in the metal. The essential factor is that the additions of elements and the modifications made to the production method do not hamper the achievement of the composition by weight of the metal and the properties of the inclusions according to the claimed invention.

What is claimed is:

1. A soft steel for machine cutting, wherein said soft steel having composition, in percentages by weight, of C≦0.25%; MN: 0.8 to 1.5%; p≦0.1%; S: 0.15 to 0.40%; Si: 0.05 to 0.40%, wherein said soft steel has been finished such that the inclusions of manganese sulfide are surrounded by a plastic oxide layer of the following average composition, expressed in percentages by weight: $SiO_2$: 35 to 45%; $Al_2O_3$: 10 to 20%; CaO: 15 to 25%; MnO: 10 to 20%.

2. A soft steel for machine cutting as claimed in claim 1, wherein its content by weight of carbon is below or equal to approximately 0.16%.

3. A soft steel for machine cutting as claimed in claim 1 or 2, wherein its calcium content is approximately 5 to 50 ppm.

4. A soft steel for machine cutting as claimed in claim 1 to 2, wherein its tellurium content is approximately 5 to 200 ppm.

5. A soft steel for machine cutting as claimed in claim 1 or 2, wherein its lead content is approximately 0.05 to 0.30%.

6. A soft steel for machine cutting as claimed in claim 1 or 2, wherein its content by weight of carbon is no greater than approximately 0.09%.

7. A process for producing, in the liquid state, a soft steel for machine cutting, said soft steel having a composition by weight of C≦0.25%; 0.8 to 1.5%; P≦0.1%; S : 0.15 to 0.40%; Si: 0.05 to 0.40%, said process including the steps of (a) adding silicon and manganese to a metal bath; and (b) agitating the liquid metal in a metallurgical vessel in the presence of a slag of a composition, expressed in percentages by weight, of CaO: 20 to 55%; $SiO_2$: 35 to 65%; $Al_2O_3$: 15 to 40%, with CaO%/$SiO_2$% of about 1.

8. A process as claimed in claim 7, wherein the addition of silicon to the metal bath is accompanied by an addition of 0.1 to 0.3 kg of aluminum per ton of steel.

* * * * *

UNITED STATES PATENT AND TRADEMARK OFFICE

CERTIFICATE OF CORRECTION

PATENT NO. : 4,978,499

DATED : December 18, 1990

INVENTOR(S) : Pierson et al

It is certified that error appears in the above-identified patent and that said Letters Patent is hereby corrected as shown below:

On the title page, Item [30], patent document is incorrect and should be corrected to read -- French Patent Application No. 88 16093, filed December 1, 1988--.

Signed and Sealed this

Twenty-sixth Day of January, 1993

*Attest:*

STEPHEN G. KUNIN

*Attesting Officer*

*Acting Commissioner of Patents and Trademarks*